US005613867A

United States Patent [19]

Hotea

[11] Patent Number: 5,613,867

[45] Date of Patent: Mar. 25, 1997

[54] ELECTRICAL CONNECTOR WITH ANTI-CHATTERING INTERCONNECTION MEANS

[75] Inventor: Gheorghe Hotea, Griesheim, Germany

[73] Assignee: The Whitaker Corporation, Wilmington, Del.

[21] Appl. No.: 503,840

[22] Filed: Jul. 18, 1995

[30] Foreign Application Priority Data

Aug. 23, 1994 [GB] United Kingdom ..... 9416986

[51] Int. Cl.[6] ..... H01R 13/52

[52] U.S. Cl. ..... 439/271; 439/382

[58] Field of Search ..... 439/382–385, 439/271–283

[56] References Cited

U.S. PATENT DOCUMENTS

| | | | |
|---|---|---|---|
| 4,193,655 | 3/1980 | Herrmann, Jr. | 439/271 |
| 4,479,691 | 10/1984 | Smith, Jr. | 439/271 |
| 4,501,462 | 2/1985 | Fidi | 439/382 |
| 5,252,088 | 10/1993 | Morello et al. | 439/271 |
| 5,328,382 | 7/1994 | Pawlicki | 439/273 |

FOREIGN PATENT DOCUMENTS

| | | |
|---|---|---|
| 0477520B1 | 8/1991 | European Pat. Off. . |
| 0632536A1 | 1/1995 | European Pat. Off. . |

*Primary Examiner*—David L. Pirlot

[57] ABSTRACT

A connector assembly comprises a primary housing and a secondary locking housing opposed of a stationary member and a slidable locking member. The stationary member is securely lockable by latch members has a shoulder for resiliently compressing a seal member. A stationary member further comprises anti-chattering protrusions mounted on integrally moulded resilient beams. The anti-chattering protrusions abut a mating surface of the complementary connector when coupled thereto. The resiliency of the anti-chattering beams, further enhanced by the resiliency of the compressed seal eliminates play between the coupled connectors thereby reducing chattering therebetween when subject to vibration.

7 Claims, 2 Drawing Sheets

Fig. 3
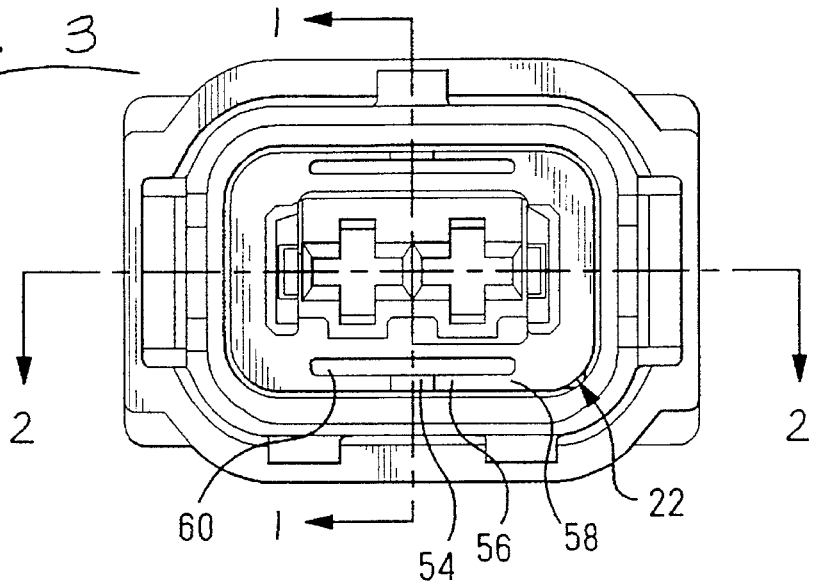
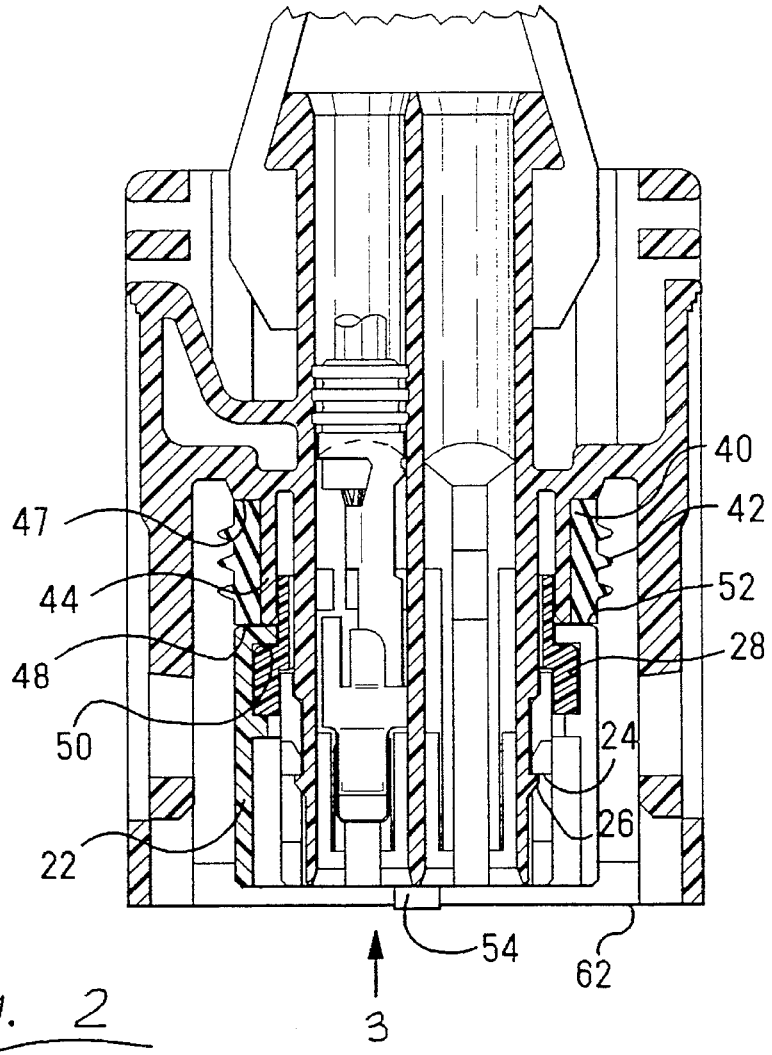
Fig. 2

ELECTRICAL CONNECTOR WITH ANTI-CHATTERING INTERCONNECTION MEANS

BACKGROUND OF THE INVENTION

1. Field of the Invention

This invention relates to a member for an electrical connector to prevent or reduce vibration between mated connectors.

2. Description of the Prior Art

Certain connectors, in particular those used in the automotive industry, are subject to vibration that may reduce the life of the electrical connection. Vibration between mating contacts of electrical connectors may cause fretting corrosion that increases the electrical resistance at the contact thereby leading to failure of the connector in some cases. The vibration between coupled connectors is aggravated by the play that exists between the connectors to allow them to couple together. The play can cause the mating connector parts to chatter with respect to each other, leading to high inertial forces and therefore increased relative movement between the mating contacts.

SUMMARY OF THE INVENTION

It is therefore desirable to reduce vibration, or chattering, between mating connector parts.

It is therefore an object of this invention to provide a member for electrical connector assemblies that reduces chattering of mated connectors.

It is a further object of this invention to provide an electrical connector assembly having a means for reducing chattering when coupled to a complementary connector assembly, in a reliable and cost-effective manner.

The objects of this invention have been achieved by providing an electrical connector securely latchable to a complementary connector for electrical connection therebetween, the connector comprising proximate the mating face, one or more resilient anti-chattering members securely attached thereto and butting resiliently against the complementary connector when mated therewith to prevent relative movement between the mated connectors when subject to vibration.

Some of the features of the connector may include a secondary housing with which the anti-chattering connectors are integrally moulded, the secondary housing mounted to the connector and butting against an elastomeric seal member that provides sealing between the latched connectors, in such a manner that the seal provides further resiliency to the anti-chattering members.

BRIEF DESCRIPTION OF THE DRAWINGS

FIG. 2 is a cross-sectional view through lines 2—2 of FIG. 1 without the complementary connector;

FIG. 3 is a view in the direction of arrow 3 of FIG. 2.

DETAILED DESCRIPTION OF THE PREFERRED EMBODIMENT

Figure 1:
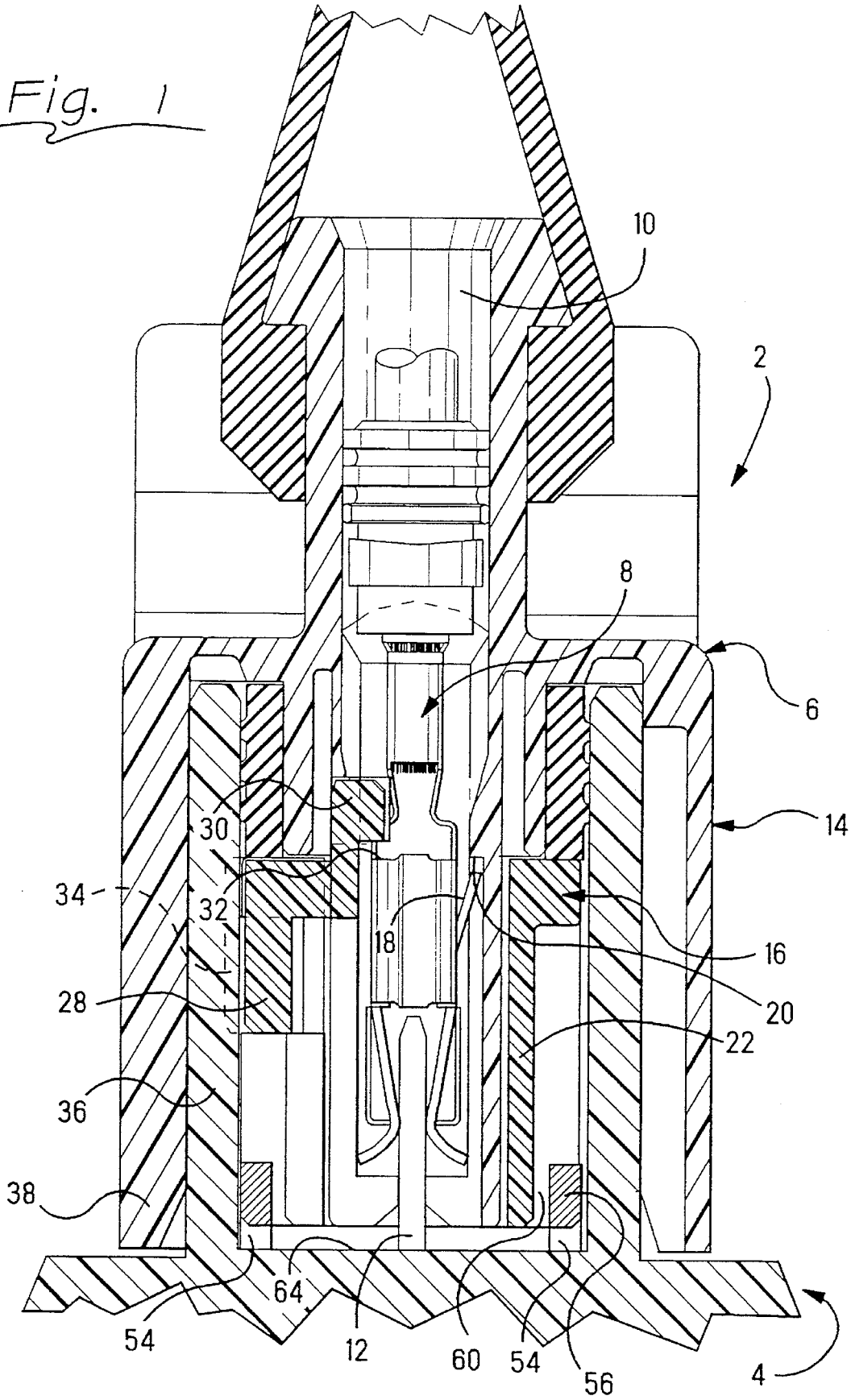
FIG. 1 is a cross-sectional view through lines 1—1 of FIG. 3 showing a preferred embodiment of this invention mated to a complementary connector assembly.

Referring first to FIG. 1, a connector assembly 2 for mating with a complementary connector assembly 4, comprises an insulative housing 6 and electrical terminals 8 receivable in cavities 10 of the housing 6. The terminals 8 are electrically connectable to complementary terminals 12 of the complementary connector assembly 4. The housing 6 comprises a primary housing 14 and a separate secondary housing 16 that is mountable to the primary housing 14 in a pre-assembly position whereby the terminals 8 can be fully inserted in the cavities 10 and locked therein by means of resilient locking lances 18 that engage behind shoulders 20 within the cavity 10. The secondary housing 16 comprises a stationary first housing member 22 which is securely and immovably latched to the primary housing 14 via complementary latching members 24, 26 between the first member and the primary housing 14. The secondary housing 16 further comprises and a second movable housing member 28 that can be moved from a pre-assembly to a fully assembled position in a direction perpendicular to the direction of insertion of the terminals 8. The moveable housing member 28 comprises a latch protrusion 30 engageable behind a shoulder 32 of the terminal 8 when fully assembled in the cavity 10. In the pre-assembly position as shown by the phantom line 34 of FIG. 1, the terminals are insertable into the cavities 10 without being obstructed by the latching protrusion 30. Once all the terminals have been inserted, the latching protrusion can then be shifted to its fully assembled position locking the terminals therein. As can be seen by the phantom line 34, the complementary connector 4 has a shroud 36 insertable within and substantially against a shroud 38 of the primary housing 14, whereby if the secondary housing movable member 34 is in the pre-assembly position there is interference with the shroud 36 thereby preventing coupling of the connectors 2,4. The terminals 8 must thus be fully assembled and the secondary locking housing in the fully assembled position prior to coupling of the connectors 2,4.

An elastomeric annular sealing member 40 is disposed around the terminal receiving cavities 10 and having annular sealing ribs 42 for compressively receiving the complementary connector shroud 36 thereagainst for sealing therebetween. The seal member 40 is mounted against an annular wall 44 that extends from a shoulder 47 against which an end of the seal abuts, the annular wall 44 having a slightly shorter axial length than the seal 40 for the reasons described hereafter. A mating end 48 of the seal thus projects slightly beyond a mating end 50 of the wall 44. When the stationary member 22 of the secondary housing 16 is latched to the primary housing 14, a shoulder 52 of the stationary member 22 abuts the mating end 48 of the seal 40 thereby slightly compressing it in the axial direction (denoted by the arrow 3). The interengaging latch means 24,26 are thus biased together by resilient compression forces of the seal 40. The stationary housing member 22 thus also serves to securely hold the annular seal 40 within the housing.

The stationary member 22 of the secondary housing 16, comprises anti-chattering projections 54 that extend from resilient beams 56 integrally moulded to the stationary member 22. The resilient beams 56 are supported at either end 58 to the stationary housing member 22 and separated therefrom by a slot 60. The anti-chattering protrusion 54 protrudes beyond a mating face 62 of the primary housing 14 such that when coupled to the complementary connector assembly 4, the anti-chattering protrusions 54 resiliently abut a mating surface 64 of the complementary connector 4. Resilient bending of the beams 56 thus eliminates any play between the coupled connectors 2,4 thereby reducing chattering between the connectors when subject to vibration. The resilient effect of the anti-chattering beams 56 and protrusions 54 is further enhanced by the resilient compression forces of the seal 40 which applies pressure against the shoulder 52 of the stationary member 22. The combined resiliency of the seal 40 and the anti-chattering beams 56, ensures on the one hand that the beams 56 are not over-stressed and will retain sufficient resiliency over the life time of the connector, and on the other hand that the seal 40 is not over-compressed which could adversely effect the sealing properties against the mating connector shroud 36.

Advantageously therefore, the resilient anti-chattering members 54,56 reduce chattering between coupled connectors when subject to vibration. Further advantageous embodiments include integral moulding of the anti-chattering members on a separate housing member that is locked to the primary housing receiving the terminals, the separate housing member slightly compressing an annular seal member for increasing the resiliency of the anti-chattering members and also retaining the seal in place and providing support for a moveable secondary locking housing member. The anti-chattering member is also very cost-effective due to the integral moulding thereof, and combined use of the sal resiliency.

I claim:

1. An electrical connector axially matable and securely latchable to a complementary connector for electrical connection therebetween, the connector comprising one or more electrical terminals received in a terminal receiving housing, characterized in that the connector comprises, proximate a mating face, one or more resilient anti-chattering members securely attached thereto and butting resiliently against a mating face of the complementary connector when mated therewith to eliminate play and prevent relative movement between the mated connectors when subject to vibration, and wherein the connector comprises an elastomeric annular seal attached to the housing and encompassing the one or more electrical terminals for engagement with a shroud of the complementary connector, the seal extending axially between a first end adjacent a shoulder of the terminal receiving housing and a mating end, whereby the anti-chattering members are securely attached to a secondary housing mounted to the terminal receiving housing and butting against the end of the seal such that when the connectors are mated, resilient butting of the anti-chattering members by the complementary connector urges the secondary housing against the seal, thereby compressing the seal.

2. The connector of claim 1 wherein the anti-chattering members are integral with the secondary housing.

3. The connector of claim 1 wherein the terminal receiving housing comprises a seal support wall extending to an end proximate the secondary housing to limit axial compression of the seal.

4. The connector of claim 1 wherein the anti-chattering members comprise a protrusion projecting in the axial direction towards the mating surface of the complementary connector and attached to a resilient beam transverse to the axial direction.

5. The connector of claim 4 wherein the beam is fixed at both ends to the secondary housing and separated therefrom by a slot extending between the ends, whereby the protrusion is disposed substantially centrally between the ends.

6. An electrical connector axially matable and securely latchable to a complementary connector for electrical connection therebetween, the connector comprising one or more electrical terminals received in a terminal receiving housing, characterized in that the connector comprises, proximate a mating face, one or more resilient anti-chattering members securely attached thereto and butting resiliently against a mating face of the complementary connector when mated therewith to eliminate play and prevent relative movement between the mated connectors when subject to vibration, and wherein the anti-chattering members comprise a protrusion projecting in the axial direction towards the mating surface of the complementary connector and attached to a resilient beam transverse to the axial direction.

7. The connector of claim 6 wherein the beam is fixed at both ends to the housing and separated therefrom by a slot extending between the ends, whereby the protrusion is disposed substantially centrally between the ends.

* * * * *